US009586718B2

(12) United States Patent
Tsai

(10) Patent No.: US 9,586,718 B2
(45) Date of Patent: Mar. 7, 2017

(54) STORAGE BASKET

(71) Applicant: Wei-Lun Tsai, Taichung (TW)

(72) Inventor: Wei-Lun Tsai, Taichung (TW)

( * ) Notice: Subject to any disclaimer, the term of this patent is extended or adjusted under 35 U.S.C. 154(b) by 0 days.

(21) Appl. No.: 15/223,570

(22) Filed: Jul. 29, 2016

(65) Prior Publication Data

US 2016/0332770 A1 Nov. 17, 2016

Related U.S. Application Data

(63) Continuation-in-part of application No. 14/516,267, filed on Oct. 16, 2014.

(30) Foreign Application Priority Data

Aug. 22, 2014 (TW) ..... 103130753 A

(51) Int. Cl.
*B65D 6/08* (2006.01)
*B65D 25/30* (2006.01)
*B65D 6/04* (2006.01)

(52) U.S. Cl.
CPC ..... *B65D 7/14* (2013.01); *B65D 7/08* (2013.01); *B65D 25/30* (2013.01)

(58) Field of Classification Search
CPC ..... B65D 7/14; B65D 25/30; B65D 7/08
USPC ..... 220/62.1, 485, 607, 642, 676, 62, 680, 220/494, 493, 495; 211/126.15; 312/330.1
See application file for complete search history.

(56) References Cited

U.S. PATENT DOCUMENTS

| | | | | |
|---|---|---|---|---|
| 6,718,635 | B2 | 4/2004 | Cheng et al. | |
| 7,270,245 | B2 | 9/2007 | Cheng et al. | |
| 8,141,737 | B1 * | 3/2012 | Tsai | B65D 7/14 220/485 |
| D689,946 | S * | 9/2013 | Hu | D19/92 |
| 2005/0077299 | A1 * | 4/2005 | Cheng | A47B 55/02 220/485 |
| 2009/0045201 | A1 | 2/2009 | Cheng et al. | |
| 2014/0069913 | A1 * | 3/2014 | Tsai | B65D 7/20 220/4.01 |

FOREIGN PATENT DOCUMENTS

TW 560512 U 11/2003

* cited by examiner

*Primary Examiner* — Robert J Hicks
*Assistant Examiner* — Kareen Thomas
(74) *Attorney, Agent, or Firm* — Muncy, Geissler, Olds & Lowe, P.C.

(57) ABSTRACT

A storage basket is provided, including a bottom meshwork and a side meshwork. The side meshwork formed with at least one mesh element extends transversely and upwardly from and surrounds the bottom meshwork. Each mesh element is an expanded metal mesh and includes a top frame portion disposed at a top end and a meshed portion located between the bottom meshwork and the top frame portion, and the expanded metal mesh is formed by using die stamping to expandedly mesh a solid metal plate. The top frame portion and the meshed portion of each mesh element are formed integrally.

11 Claims, 12 Drawing Sheets

STORAGE BASKET

FIELD OF THE INVENTION

The present invention is a CIP of application Ser. No. 14/516,267, filed Oct. 16, 2014, the entire contents of which are hereby incorporated by reference.

BACKGROUND OF THE INVENTION

Description of the Prior Art

It is common to use a meshwork as a main body of a storage basket, and the meshwork is cut and assembled to form the main body of the storage basket.

For example, as disclosed in U.S. Pat. No. 7,270,245, a storage basket includes a bottom meshwork and two side meshworks. The bottom meshwork is bent to form two lateral wings. The two side meshworks are connected with and between the lateral wings. An end frame is connected to an upper edge of the lateral wings and the side meshworks. Then, the storage basket is accomplished. Furthermore, similar storage baskets are also disclosed in U.S. Pat. No. 6,718,635 and TW 560512.

The prior art as described above, the end frame is necessary to be clampingly disposed on an opening periphery of the storage basket after plural meshworks are assembled. Nevertheless, it costs material for the end frame and is hard to manufacture, and a structure strength of a connection between the end frame and the main body is weak.

Moreover, the prior art further has other disadvantages. An opening where an upper periphery of the main body is assembled with the end frame is unmodified and has sharp edges; therefore, when a user holds it by hand, the user might get injured. Besides, a surface of the sharp edge is hard to paint and easy to flake off; hence, it rusts easily, and the structure strength is reduced.

US20090045201 discloses separate sidewall and top frame portion (954) (not formed of one-piece), the sidewall members (115a) are not directly expanded and stretched from the single solid metal plate. The sidewall includes a plurality of sidewall members (115a), each of the sidewall members (115a) is a meshwork separate from the top frame portion (954), and the top frame portion (954) is additionally attached to the top end of the sidewall members (115a). The top frame portion (954) is necessary to be clamped on an opening periphery of the storage basket after plural meshworks are assembled. It costs material for the top frame portion (954) and is hard to manufacture, and a structural strength of a connection between the top frame portion (954) and the sidewall members (115a) is weak. An opening where an upper periphery of the sidewall members (115a) is assembled with the top frame portion (954) is unmodified and has sharp edges; therefore, when a user holds it by hand, the user might get injured. Besides, a surface of the sharp edge is hard to paint and easy to flake off; hence, it rusts easily, and the structure strength is reduced.

The present invention has arisen to mitigate and/or obviate the afore-described disadvantages.

SUMMARY OF THE INVENTION

The primary object of the present invention is to provide a storage basket. It is easy and fast to manufacture. It also saves material and costs low. It has a structure with strong strength and is durable, and it has no sharp edges, and it is safe to use and nice to look at. The structure is convenient to assemble and connect and has a good structure strength, so it is hard to deform and be damaged and has a long lifespan.

To achieve the above and other objects, a storage basket in accordance with the present invention includes a bottom meshwork and a side meshwork. The side meshwork formed with at least one mesh element extends transversely and upwardly from and surrounds the bottom meshwork. Each mesh element is an expanded metal mesh and includes a top frame portion disposed at a top end and a meshed portion located between the bottom meshwork and the top frame portion, and the expanded metal mesh is formed by using die stamping to expandedly mesh a solid metal plate. The top frame portion and the meshed portion of each mesh element are formed integrally.

DETAILED DESCRIPTION OF THE PREFERRED EMBODIMENTS

Figure 1:
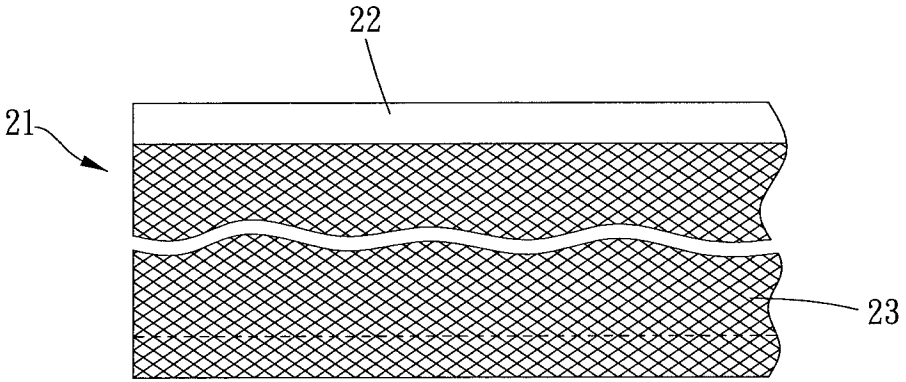
FIGS. 1-4 are perspective drawings of a storage basket in accordance with a first preferred embodiment of the present invention.
Figure 2:
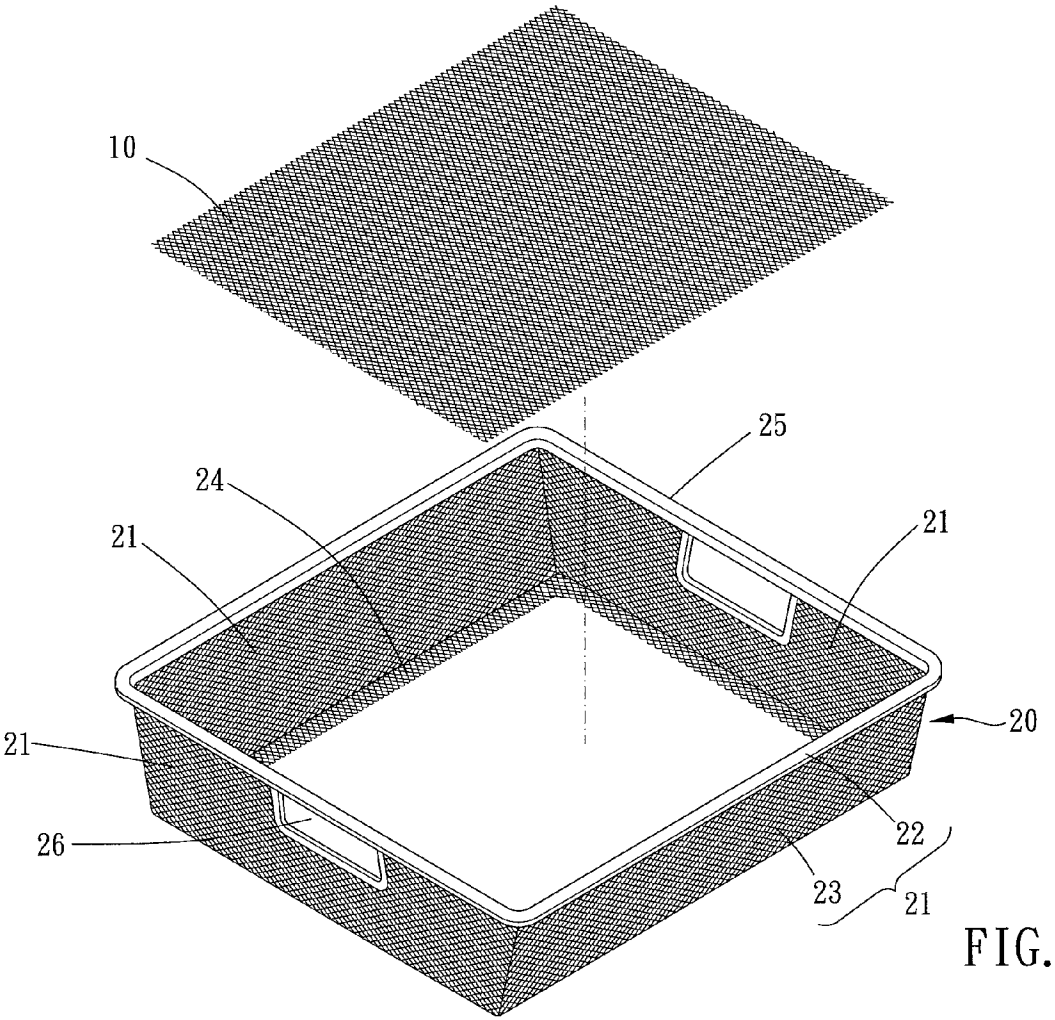
Figure 3:
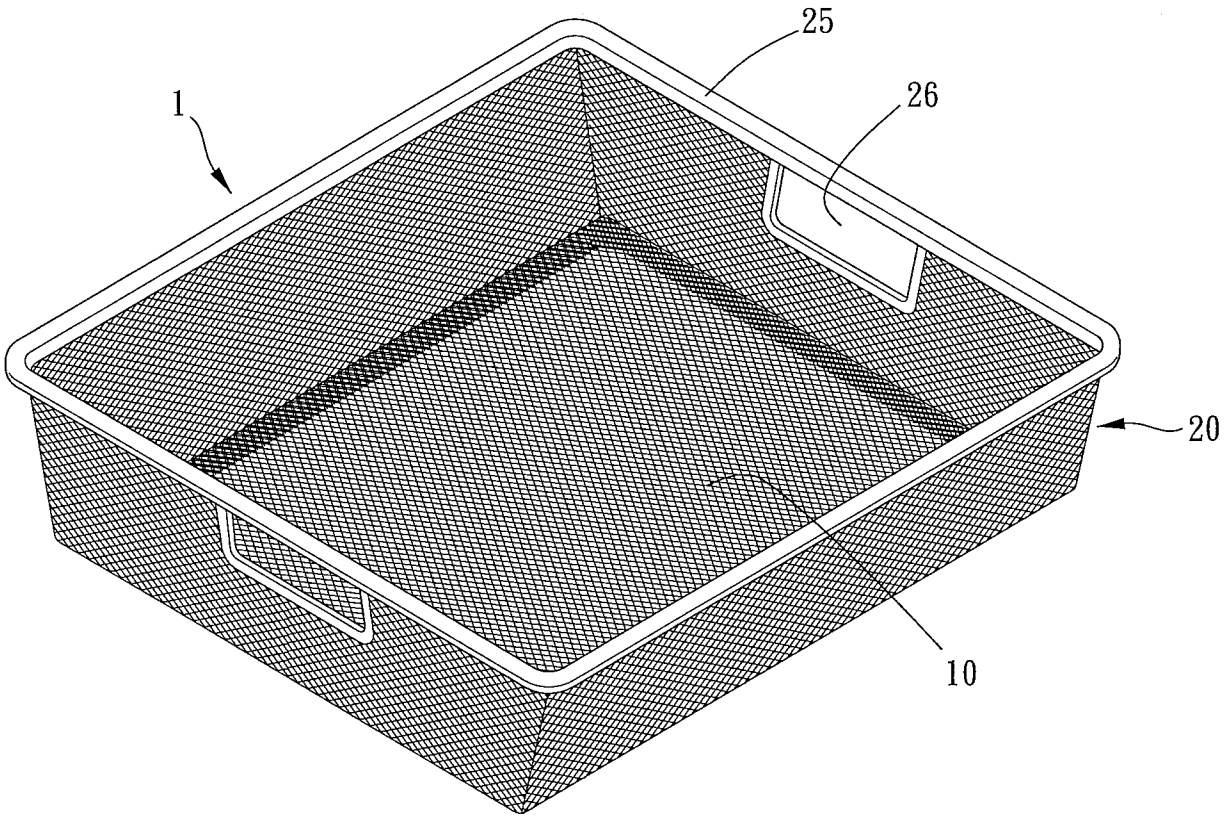

The present invention will be clearer from the following description when viewed together with the accompanying drawings, which show, for purpose of illustrations only, the preferred embodiment in accordance with the present invention.

Referring to FIGS. 1-4, a storage basket 1 in accordance to a first preferable embodiment includes a bottom meshwork 10 and a side meshwork 20.

The side meshwork 20 is formed with at least one mesh element 21. The side meshwork 20 extends transversely and upwardly from the bottom meshwork 10 and surrounds the bottom meshwork 10, and each mesh element 21 is integrally formed of one piece. Each mesh element 21 is an expanded metal mesh and includes a top frame portion 22 which is a solid frame and disposed at a top end and a meshed portion 23 located between the bottom meshwork 10 and the top frame portion 22, and the expanded metal mesh is integrally formed of one piece by using die stamping to expandedly mesh a single solid metal plate. The top frame portion 22 and the meshed portion 23 of each mesh element 21 are integrally continuously formed of one piece and are not additionally assembled with each other. For example, the meshed portion 23 of the mesh element 21 can be directly formed by expanding and stretching a sheet material (single solid metal plate) through an expanding machine or other machining processes (without removing any materials of the sheet material), and a portion of the sheet material without mesh holes can be used as the top frame portion 22. It is easy and fast for manufacturing, and it saves material and costs low. It also has a strong structure and a good appearance by forming integrally.

In the present embodiment, the side meshwork 20 is formed with one single said mesh element 21, and a bottom end of the mesh element 21 is connected with the bottom meshwork 10. And two lateral ends of the mesh element 21 are connected with each other. The storage basket 1 is a structure with two members. Specifically, a bottom end of the side meshwork 20 is foldingly formed with a connecting lip 24 substantially parallel to the bottom meshwork 10, and the bottom end of the side meshwork 20 is connected with the connecting lip 24. It is convenient for the bottom meshwork 10 to dispose on and connect with the side meshwork 20 via the connecting lip 24, and it also increases a structure strength of a connection between the bottom meshwork 10 and the side meshwork 20. The bottom meshwork 10 and the side meshwork 20 are connected with each other through welding, fusing or any applicable method.

Figure 4:
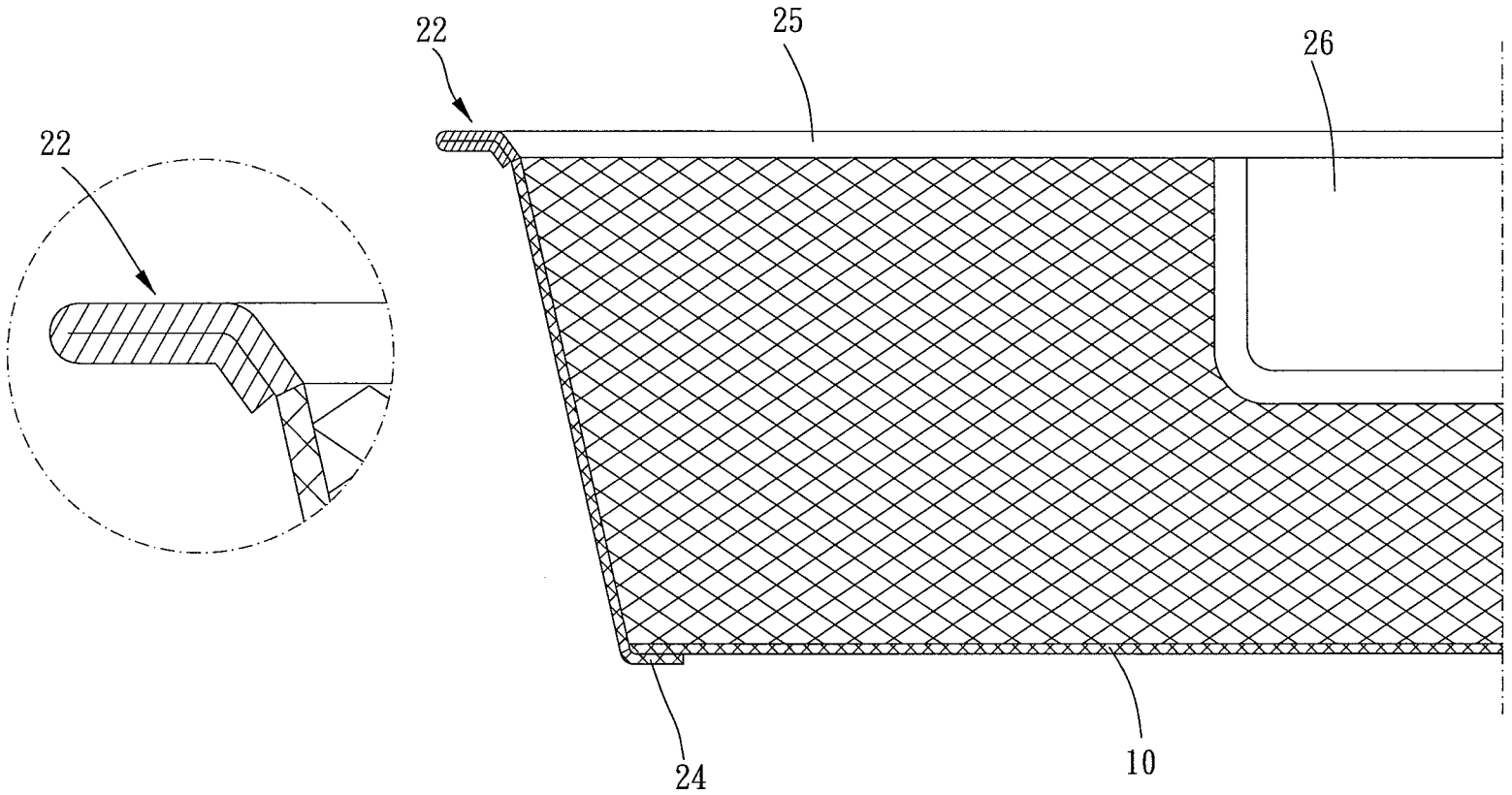
Figure 5:
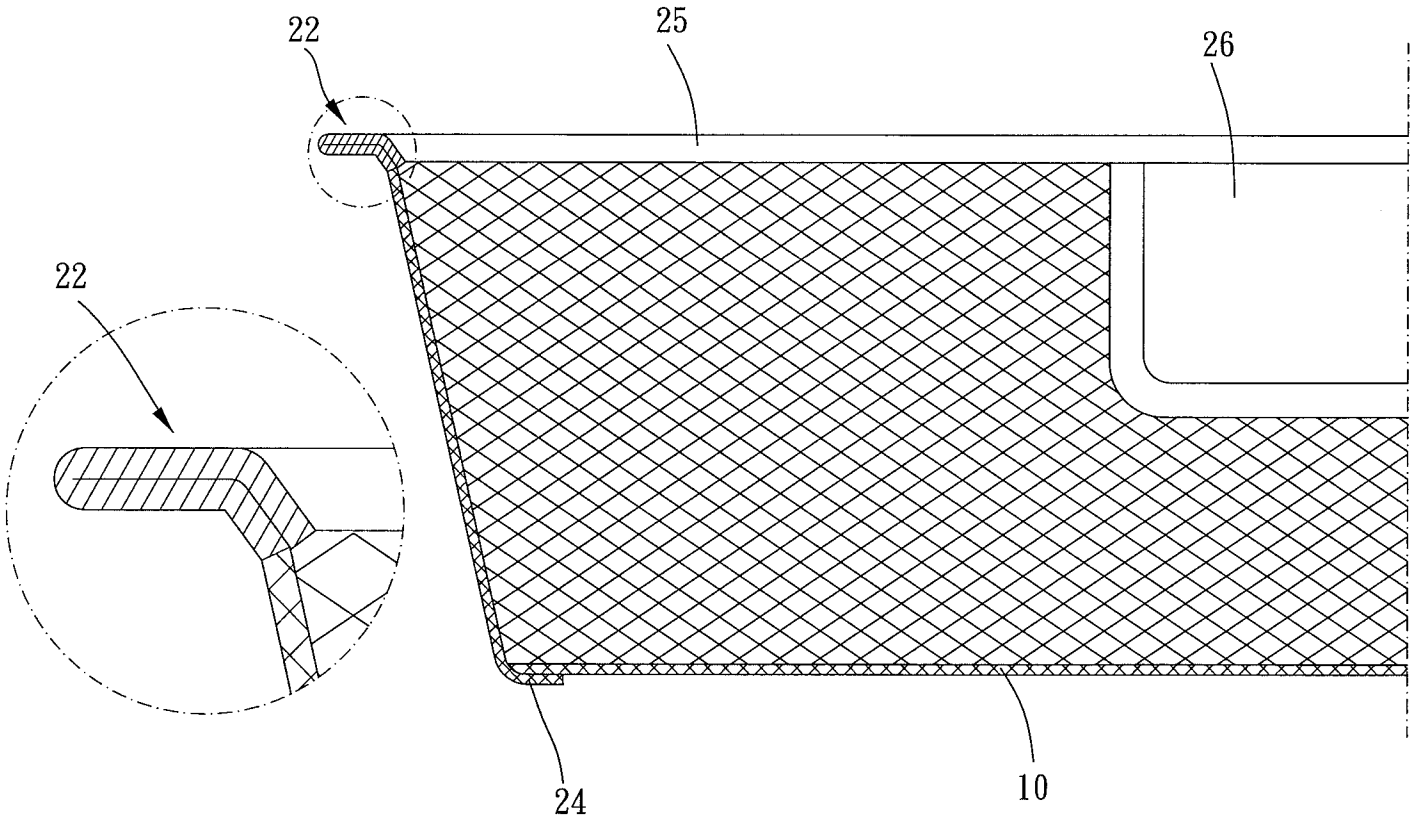
FIG. 5 is a perspective drawing of the storage basket in accordance with the first preferred embodiment of the present invention in another type.

Two ends of the top frame portion 22 of the mesh element 21 are connected with each other to form a top frame 25. In the present embodiment, the top frame portion 22 of each mesh element 21 is turned outward and folded reversely to be laminated (as shown in FIG. 4). It increases a strength of an opening periphery of the storage basket 1 and prevents the storage basket 1 from damaging. Preferably, each top frame portion 22 at least partially bends toward the bottom meshwork 10. It further increases the strength of the opening periphery of the storage basket 1, and it is beneficial and comfortable for a hand to hold without injuring the hand. It is also has no sharp edge, so it is safe to use. It is noted that the top frame portion 22 of the mesh element 21 can be also turned inward and folded reversely to be laminated (as shown in FIG. 5), or it can be a flat structure without being turned and folded.

Moreover, the side meshwork 20 of the storage basket 1 is formed with two hollow portions 26 which are opposite to each other and for holding and lifting, and it is convenient for a user to hold and apply a force steadily.

Figure 6:
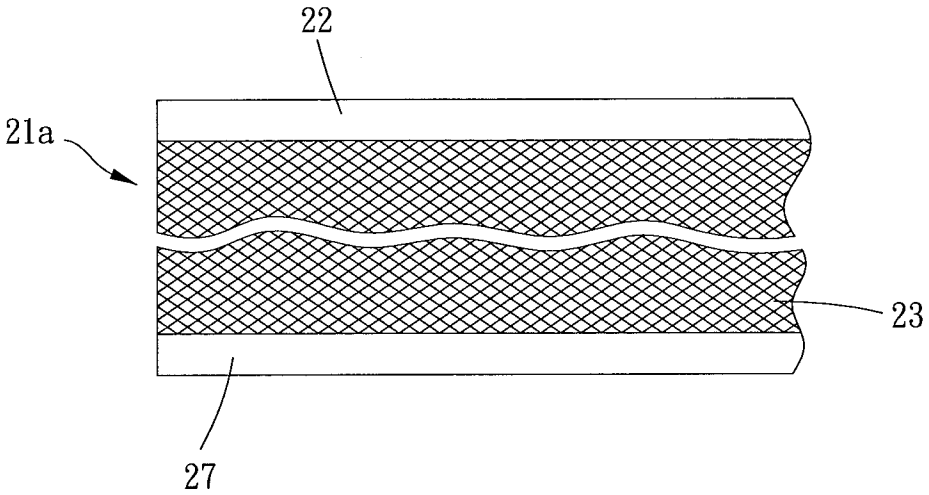
FIGS. 6-7 are perspective drawings of the storage basket in accordance with a second preferred embodiment of the present invention.
Figure 7:
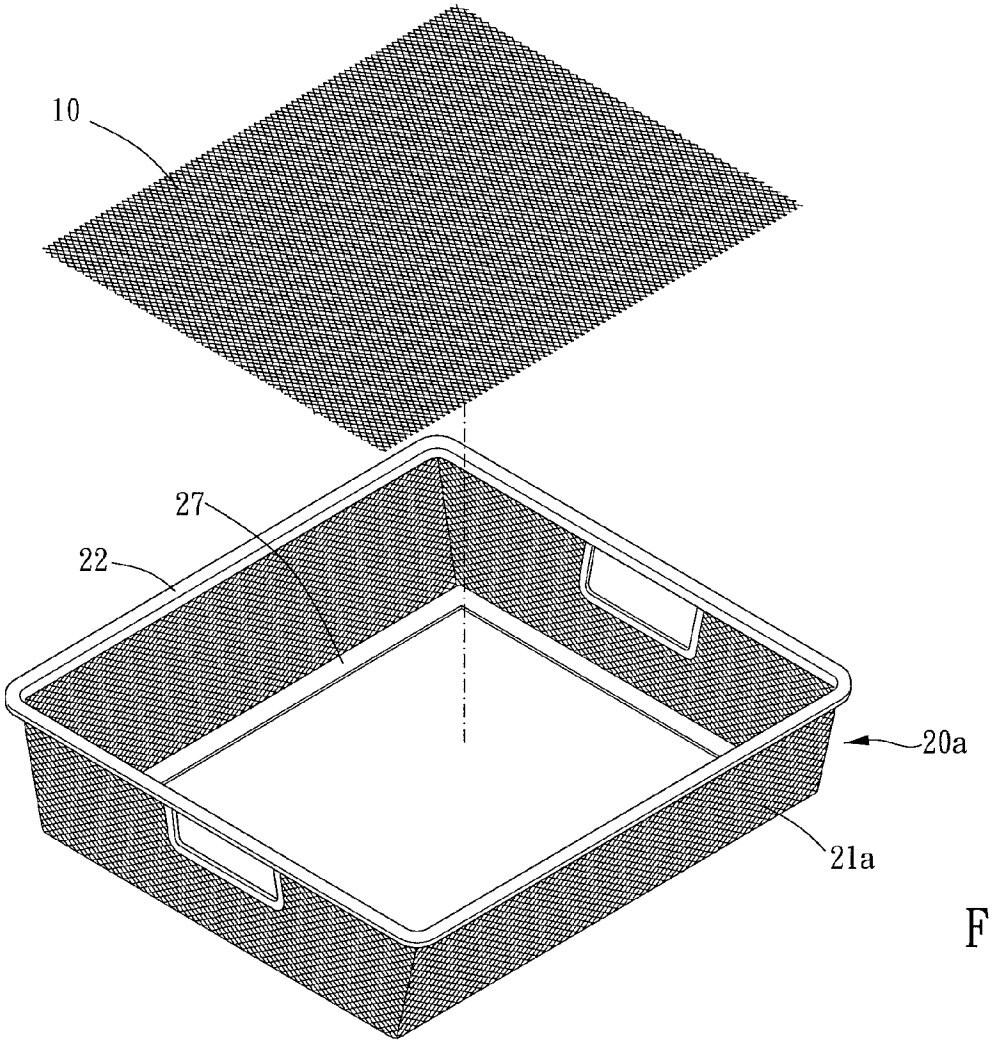

Please refer to FIGS. 6 and 7 for a second preferred embodiment. Compared with the first preferred embodiment, a mesh element 21*a* of a side meshwork 20*a* is further formed with a bottom frame portion 27 at a bottom end, and the bottom frame portion 27 is connected with the bottom meshwork 10. Wherein the bottom frame portion 27 increases a structure strength of the side meshwork 20*a* and the bottom meshwork 10, so it is hard to deform and be damaged and has a long lifespan.

Figure 8:
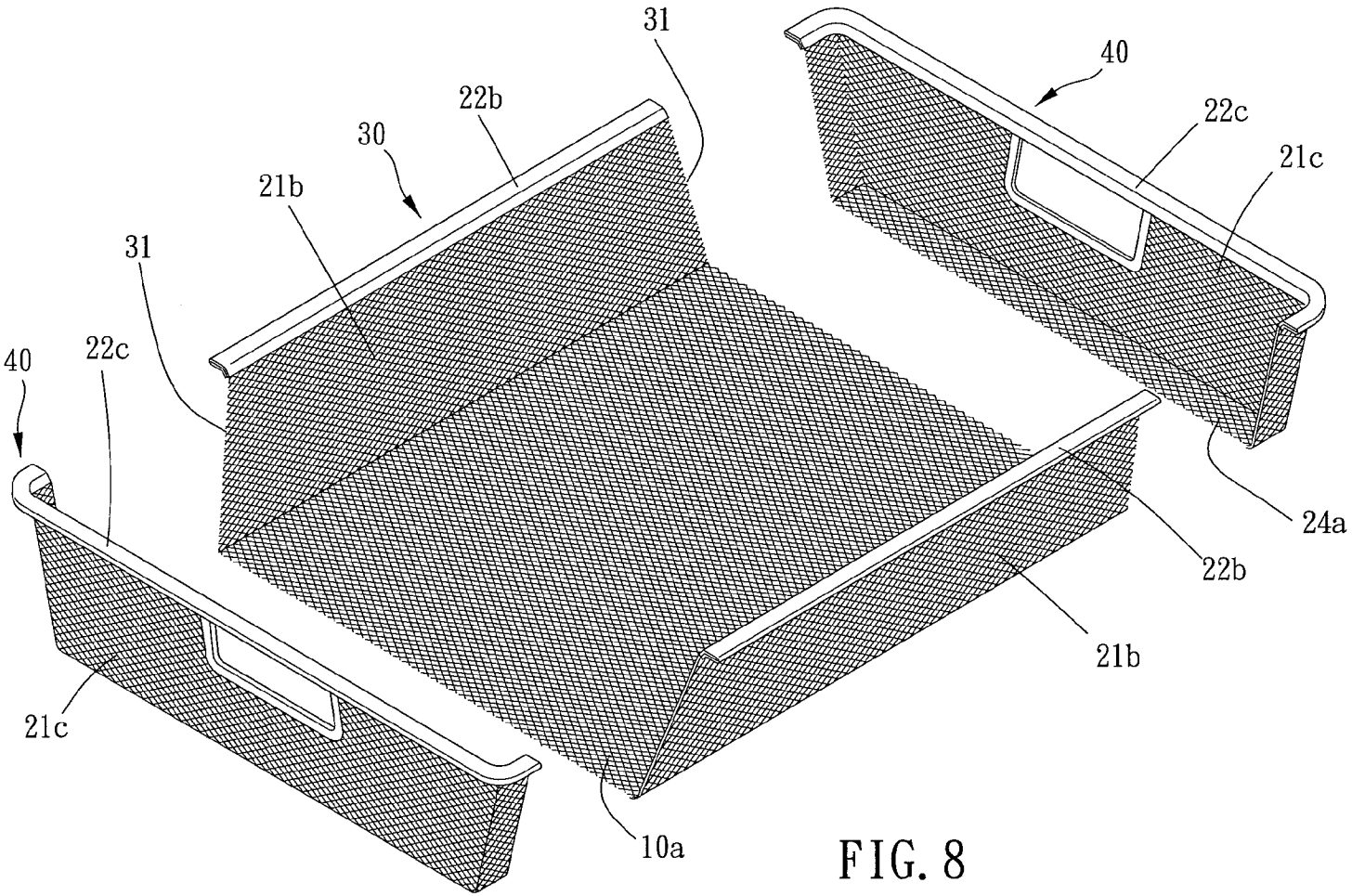
FIGS. 8-10 are perspective drawings of the storage basket in accordance with a third preferred embodiment of the present invention.
Figure 9:
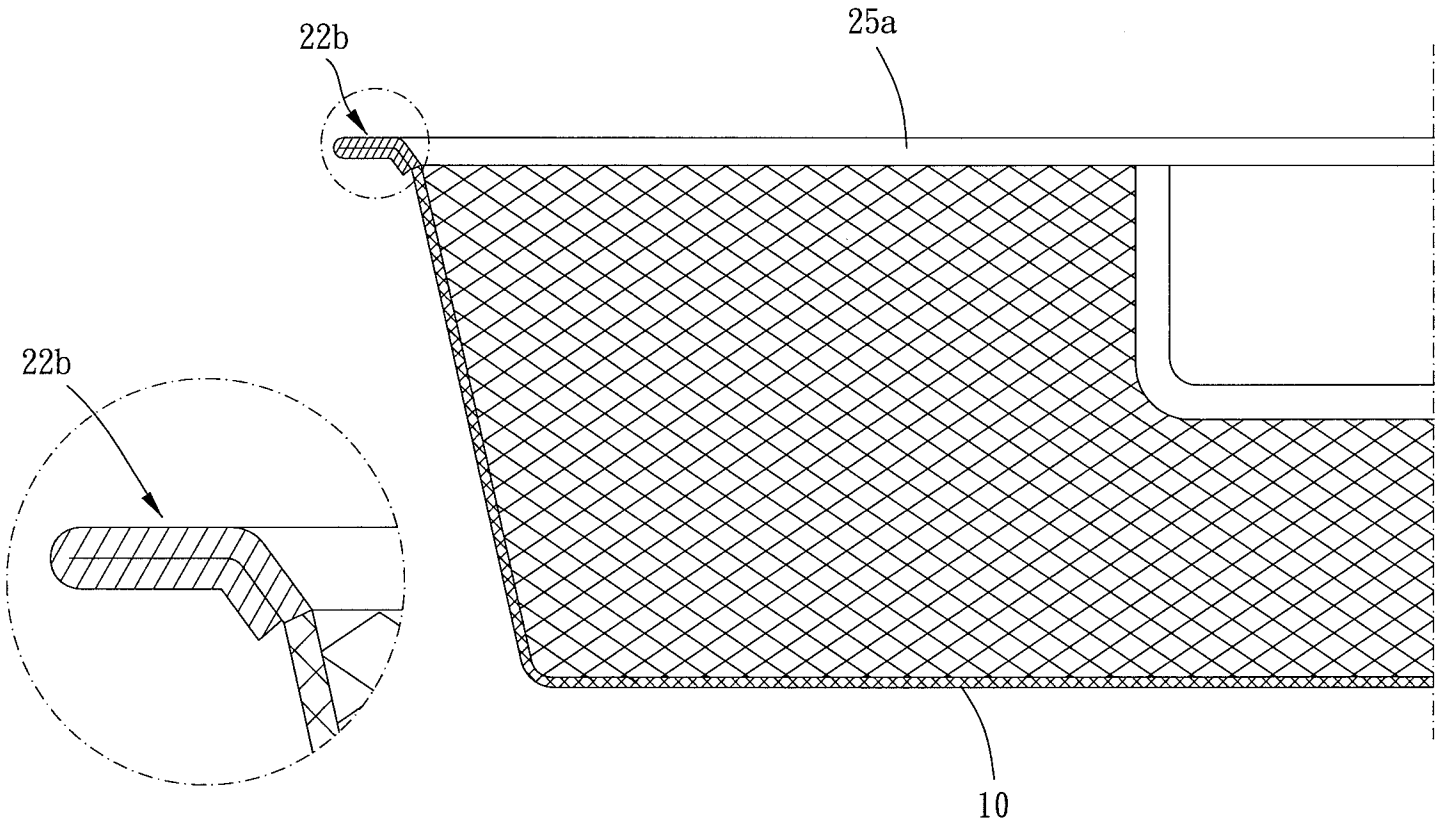
Figure 10:
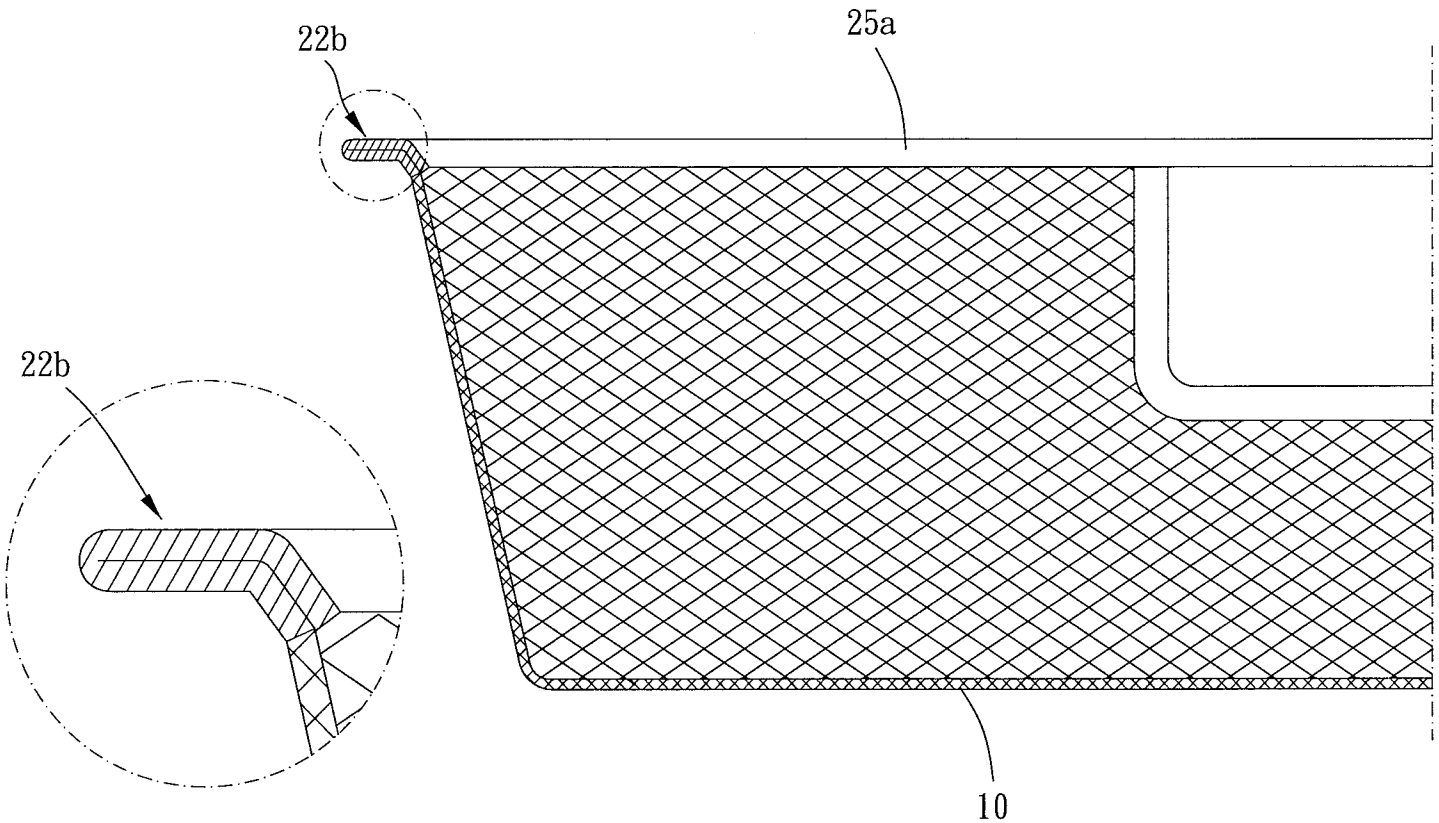

Please refer to FIGS. 8-10 for a third preferred embodiment, compared with the first preferred embodiment, a storage basket includes a first mesh member 30 which is integrally formed and two second mesh members 40 which are respectively integrally formed. The first mesh member 30 is formed substantially of a U-shaped structure and includes two opposite U-shaped end edges 31. The first mesh member 30 includes a bottom meshwork 10*a* and two of mesh elements 21*b* which extend transversely and upwardly from two ends of the bottom meshwork 10*a*. Two top frame portions 22*b* are respectively disposed at two opposite distal ends of the U-shaped structure. Each second mesh member 40 is formed with a mesh element 21*c* and a top frame portion 22*c* at a top end. The two second mesh members 40 are respectively coveringly connected to the two U-shaped end edges 31. The top frame portion 22*b* of the first mesh member 30 and the top frame portions 22*c* of the two second mesh members 40 are connected to form a top frame 25*a*. The storage basket is a structure with three members, and it is convenient to mold, assemble and connect.

Preferably, each second mesh member 40 further includes a connecting lip 24*a* corresponding to the U-shaped end edges 31. Each connecting lip 24*a* is disposed substantially along the corresponding U-shaped end edges 31 and extends parallel to the first mesh member 40, and the U-shaped structure is connected with the two connecting lips 24*a*. The two second mesh members 40 are convenient to dispose on and connect with the first mesh member 30 via the two connecting lips 24*a*, and a structure strength of a connection between the two second mesh members 40 and the first mesh member 30. It is noted that a structure of the top frame 25*a* can be turned outward and folded reversely to be laminated or turned inward and folded reversely to be laminated.

Figure 11:
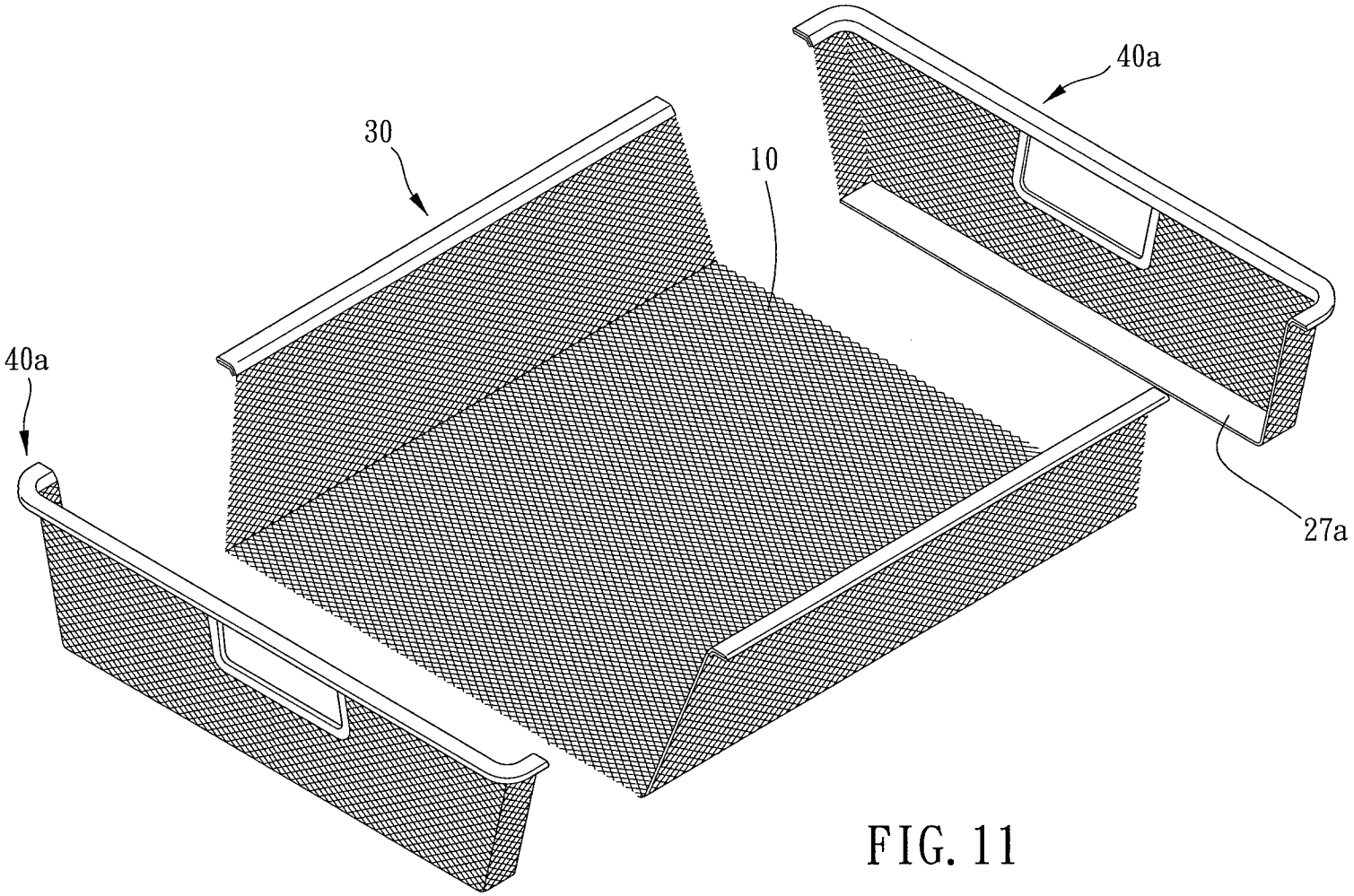
FIGS. 11-12 are perspective drawings of the storage basket in accordance with a fourth preferred embodiment of the present invention.
Figure 12:
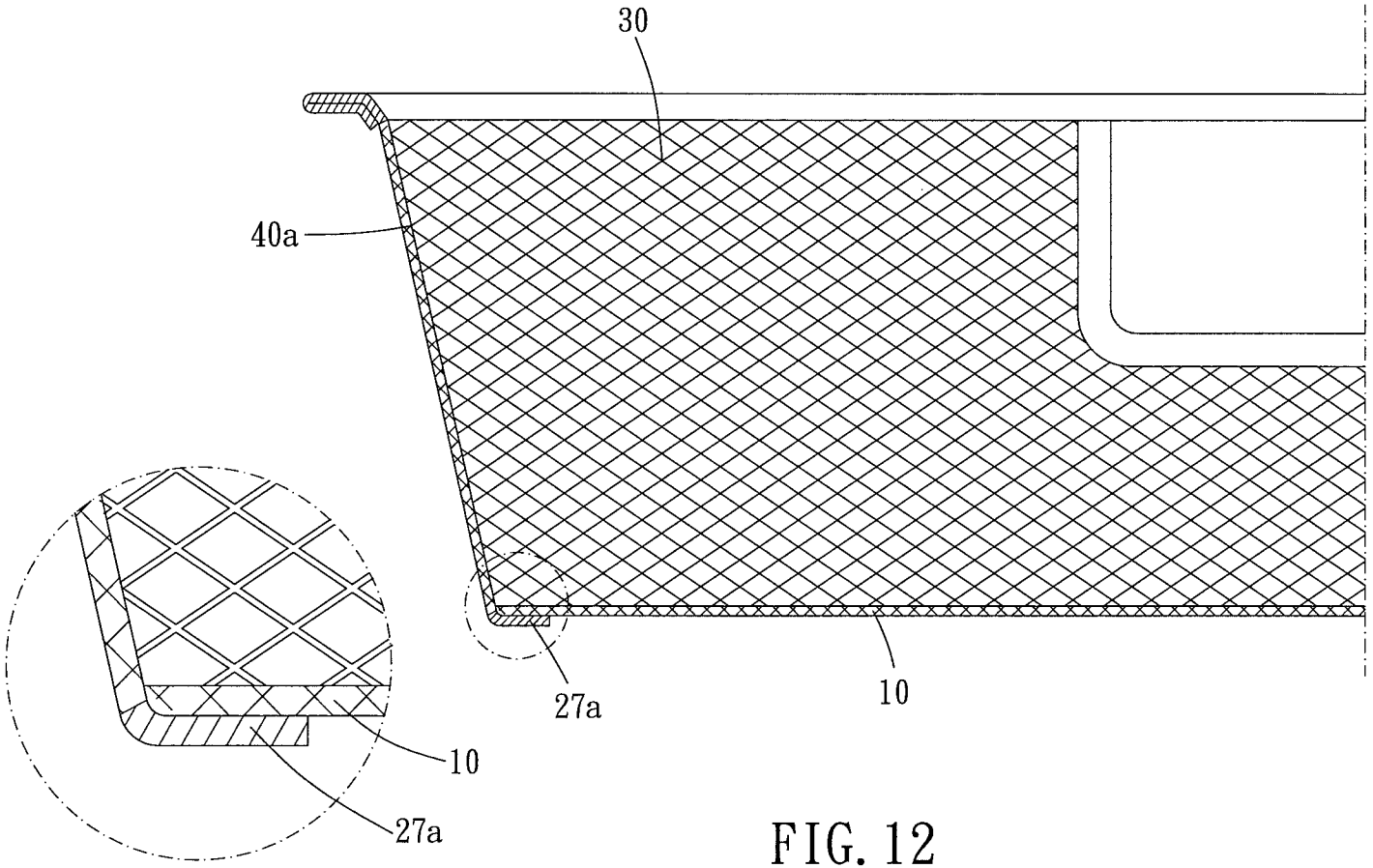

Please refer to FIGS. 11 and 12 for a fourth preferred embodiment, compared with the third embodiment, each second mesh member 40*a* further includes a bottom frame portion 27*a* disposed at a bottom end, and the bottom frame portion 27*a* is connected with a bottom meshwork 10. A structure as described above increases a structure strength and is hard to deform and be damaged, and it has a long lifespan.

As a conclusion, the top frame portion and the meshed portion of each mesh element of the storage basket are formed integrally, and the storage basket is easy and fast to manufacture. It also saves material and costs low. It has a structure with strong strength and is durable. It has no sharp edges, so it is safe to use and nice to look at.

Besides, the storage basket is selectable to be formed with the connecting lip at the bottom end of the side meshwork to make it convenient for the bottom meshwork to be disposed on and connected with the side meshwork and increase the structure strength of the connection between the bottom meshwork and the side meshwork.

Moreover, the storage basket is selectable to be formed with the bottom frame portion at the bottom end of the side meshwork to increase the structure strength of the side meshwork and the bottom meshwork; therefore, it is hard to deform and be damaged and has a long lifespan.

While we have shown and described various embodiments in accordance with the present invention, it should be clear to those skilled in the art that further embodiments may be made without departing from the scope of the present invention.

What is claimed is:

1. A storage basket, comprising:

a bottom meshwork;

a side meshwork, formed with at least one mesh element, extending transversely and upwardly from and surrounding the bottom meshwork, each mesh element being integrally formed of one piece, each mesh element being an expanded metal mesh and including a top frame portion which is a solid frame and disposed at a top end and a meshed portion located between the bottom meshwork and the top frame portion, the expanded metal mesh being integrally formed of one piece by using die stamping to expandedly mesh a single solid metal plate, the top frame portion and the meshed portion of each mesh element being integrally continuously formed of one piece and are not additionally assembled with each other;

wherein the meshed portion of the at least one mesh element is directly expanded and stretched from the single solid metal plate without removing any materials of the single solid metal plate, and a portion of the single solid metal plate without mesh holes is the top frame portion.

2. The storage basket as claimed in claim 1, wherein the side meshwork is formed with one of said at least one mesh element, a bottom end of the mesh element is connected with the bottom meshwork, and two lateral ends of the mesh element are connected with each other.

3. The storage basket as claimed in claim 2, wherein the mesh element is further formed with a bottom frame portion at a bottom end, and the bottom frame portion is connected with the bottom meshwork.

4. The storage basket as claimed in claim 2, wherein a bottom end of the side meshwork is foldingly formed with a connecting lip substantially parallel to the bottom meshwork, and the bottom meshwork is connected with the connecting lip.

5. The storage basket as claimed in claim 1, wherein the storage basket includes a first mesh member which is integrally formed and two second mesh members which are respectively integrally formed, the first mesh member is formed substantially in a U-shaped structure and includes opposite two U-shaped end edges, the first mesh member includes the bottom meshwork and two of the mesh elements which extend transversely and upwardly from two ends of the bottom meshwork, the two top frame portions are respectively disposed at two opposite distal ends of the U-shaped structure, each of the second mesh members is formed with one said mesh element and one said top frame portion at a top end, the two second mesh members are respectively coveringly connected to the two U-shaped end edges, and the top frame portions of the first mesh member and the top frame portions of the two second mesh members are connected to form a top frame.

6. The storage basket as claimed in claim 5, wherein each second mesh member further includes a connecting lip corresponding to the U-shaped end edges, each connecting lip is disposed substantially along the corresponding U-shaped end edges and extends parallel to the first mesh member, and the U-shaped structure is connected with the two connecting lips.

7. The storage basket as claimed in claim 5, wherein each of the second mesh members further includes a bottom frame portion disposed at a bottom end, and the bottom frame portion is connected with the bottom meshwork.

8. The storage basket as claimed in claim 1, wherein the top frame portion of each said at least one mesh element is turned outward and folded reversely to be laminated.

9. The storage basket as claimed in claim 1, wherein the top frame portion of each said at least one mesh element is turned inward and folded reversely to be laminated.

10. The storage basket as claimed in claim 1, wherein each top frame portion at least partially bends toward the bottom meshwork.

11. The storage basket as claimed in claim 1, wherein the side meshwork is formed with two hollow portions opposite to each other and for holding and lifting.

* * * * *